US006430885B1

(12) United States Patent
Ito

(10) Patent No.: US 6,430,885 B1
(45) Date of Patent: Aug. 13, 2002

(54) FASTENED STRUCTURE OF SIDING BOARDS

(75) Inventor: Hiroshi Ito, Aichi (JP)

(73) Assignee: Nichiha Corporation (JP)

( * ) Notice: Subject to any disclaimer, the term of this patent is extended or adjusted under 35 U.S.C. 154(b) by 0 days.

(21) Appl. No.: 09/663,150

(22) Filed: Sep. 15, 2000

(30) Foreign Application Priority Data

Dec. 24, 1999 (JP) ..... 11-367563

(51) Int. Cl.[7] ..... E04B 2/30

(52) U.S. Cl. ..... 52/483.1; 52/282.1; 52/235; 52/478

(58) Field of Search ..... 52/481.1, 489.1, 52/489.2, 512

(56) References Cited

U.S. PATENT DOCUMENTS 5,475,960 A * 12/1995 Lindal ..... 52/478
5,644,878 A * 7/1997 Wehrmann ..... 52/287.1
5,893,245 A * 4/1999 Sekiguchi et al. ..... 52/235

FOREIGN PATENT DOCUMENTS

JP Sho 55-108551 8/1980
JP 2602190 6/1993
JP Hei 7-931 1/1995

OTHER PUBLICATIONS

Japanese Office Action for Patent Application No. 11–367563 dated Dec. 12, 2001, 4 pages.
Patent Abstracts of Japan, Publication No. 05163780A (corresponding to Ref. A3 above).

* cited by examiner

*Primary Examiner*—Carl D. Friedman
*Assistant Examiner*—Steve Varner
(74) *Attorney, Agent, or Firm*—Rosenthal & Osha L.L.P.

(57) ABSTRACT

A fastened structure wherein flat siding boards such as ceramic siding boards are fastened to the side of a building by making use of a fastening member. A first engaging members each having an engaging groove and an engaging hook are attached to the side of a building at predetermined intervals "d". On the other hand, the siding board is provided on the rear surface thereof with a number of a second engaging members each having an engaging projection which is adapted to be engaged with the engaging hook of the first engaging member. The siding boards can be fastened in multistage vertically to the side of the building by pressing the siding board onto the side of a building so as to cause the first engaging member to engage with the second engaging member.

11 Claims, 13 Drawing Sheets

FASTENED STRUCTURE OF SIDING BOARDS

BACKGROUND OF THE INVENTION

1. Field of the Invention

The present invention relates to a fastened structure wherein flat siding boards such as ceramic siding boards are fastened to the side of a building by making use of a fastening member.

2. Description of the Related Arts

As an exterior finish work of a building, a board siding work for attaching ceramic siding boards (siding boards) to the side of a building is usually performed.

For example, as shown in FIGS. 11 and 12, in the case of wood frame construction (two-by-four construction) for example, a framework 1 is assembled at first, and if necessary after an underlayment 2 such as a plywood and a moisture permeable waterproofing sheet is attached to the framework 1, ceramic siding boards 20 are horizontally fastened via the underlayment 2 to the framework 1 by taking advantage of the studs (vertical frame) 3 of the framework 1 with the longitudinal direction of the siding boards 20 being directed in the lateral direction (horizontal direction).

In this case, a first siding board 20 to be disposed at the lowest portion of the framework 1 is horizontally placed at first to the framework 1 and fastened thereto using screws or nails 4 by taking advantage of upright studs 3. Then, a second siding board 20 to be fastened over the first siding board 20 is horizontally placed with the lower rabbeted horizontal edge 20*a* of the second siding board being fitted over or engaged with the upper rabbeted horizontal edge 20*b* of the first siding board 20, and then fastened to the studs 3 in the same manner as illustrated above using screws or nails 4. Since the head 5 of the nail 4 employed in fastening the siding board 20 is exposed in this case, thus deteriorating the external appearance or design of the finish, a coating coverage is usually subsequently applied to such an exposed head portion of the nails 4. Further, there is also a possibility that the siding boards 20 may be damaged due to the nailing work.

As an alternative siding work, a method of fastening the siding boards by making use of a fastening member exclusively dedicated for the siding boards has been proposed as taught in Japanese Patent Unexamined Publication H9-203184. FIG. 13 shows one example of such a metallic fastening member (hereinafter, referred to also as a fastening member) 60. This metallic fastening member 60 is constructed such that the contacting face portion 61*a* thereof to the underlayment 2 (studs 3) is disposed parallel with and spaced away by a predetermined distance from the supporting face portion 61*b* thereof for supporting the back surface of a siding board, said predetermined distance being secured by the existence of the connection portion 61*c* and bent portion 61*d* of the metallic fastening member 60. A mounting portion 62 extending horizontally is projected from the supporting face portion 61*b*, thereby permitting the shiplap portions of a couple of the neighboring upper and lower siding boards 20A and 20B to be fitted therein and engaged with each other, the shiplap portions being formed respectively on the horizontal edge portions 20*a* and 20*b*, facing each other, of the neighboring upper and lower siding boards 20A and 20B.

The installation of the siding boards 20 can be performed as follows. First of all, as shown in FIG. 14, the lowermost siding board 20B is horizontally positioned by a suitable means. Then, the upper horizontal edge portion 20*a* of the lowermost siding board 20B is permitted to engage with the underside portion of mounting portion 62 of the fastening member 60, thereby positioning the fastening member 60. Then, the fastening member 60 is fixed in place by means of screws or nails 4. This procedure is repeated to fix a desired number of the fastening members 60 side by side to the studs 3. Then, the lower horizontal edge portion 20*b* of the next upper siding board 20A is permitted to engage with the upper side portion of mounting portion 62 of the fastening member 60 that has been fixed in advance, thereby horizontally positioning this upper siding board 20A. Then, in the same manner as described above, the upper horizontal edge portion 20*a* of this siding board 20A that has been horizontally positioned is permitted to engage with the underside portion of mounting portion 62 of another fastening member 60, and then, this fastening member 60 is fixed in place by means of screws or nails 4. Thereafter, the same procedures as described above are repeated to attach the siding boards 20 horizontally and in multistage to the side of a building, thereby accomplishing a decorative external side.

This fastening method is advantageous in that there is little possibility of damaging the surface of the siding boards, and the existence of the metallic fastening member 60 cannot be externally recognized, thus making it possible to provide a fastened state of siding boards which is very excellent in external appearance. Further, since an air flow space "Sc" can be formed between the siding boards 20 thus fastened and the underlayment 2 in this decorative external side formed in this manner, it is possible to inhibit the generation of dew on the rear side of the siding boards 20. This fastening method using the aforementioned fastening member 60 is advantageous in that it is applicable not only to a building method using a wood frame but also to a building method using a steel frame.

This fastening method of siding boards using the aforementioned fastening member is very effective in the siding work wherein the fastening of siding boards is executed to the side of a building where studs are regularly arranged at predetermined intervals as in the cases of wood frame construction using a wooden framework, a wooden building according to the traditional Japanese wooden building style, or a steel structure. However, it is difficult to apply this fastening method to an existing mortar-finish or concrete wall where the studs (vertical furring strips) are not exposed from the side of a building. Because, it is difficult to stably attach a large number of fastening members to such a mortar-finish or concrete wall. Therefore, it is not easy to apply this siding work to a so-called reform work where an existing side of a building is covered by a new kind of siding board.

Further, when it is required to exchange some or all of the siding boards with new ones in view of modifying the external design of side of a building or for the purpose of repairing the damage of part of siding boards, the fastening members that have been fixed to the side of a building are required to be dismounted therefrom for the exchange of the siding boards, the fastening members being subsequently reattached to the side of a building by means of nails or screws. Since the insertion of nails or screws into the same locations as the original locations would give rise to the instability of the fastening members newly attached in this fixing work, the locations for attaching the nails or screws are required to be changed to quite new locations, thus making this exchange work troublesome.

Since the fastening member to be employed in the horizontal board siding work is designed to allow the shiplap portion (the underlying tongue portion and the overlying tongue portion) formed on the upper and lower horizontal edge of the siding board to be secured thereto, when a large degree of the surface load is imposed on the front or rear surface of the fastened siding board, the load is mainly borne by the upper and lower fastening members. The siding boards available in the market at present is relatively small in surface area per sheet, so that there is not any particular inconvenience. However, if a fastening method employing the aforementioned conventional fastening member is adopted as it is for fastening a siding board of large surface area which is expected to be placed on the market in future, it would be impossible to secure a sufficient bearing force by making use of only the aforementioned conventional fastening members placed respectively on the upper and lower horizontal edges of a siding board, so that it is expected that the fastening portion of the fastening member may be damaged or the fastening member may be disengaged.

SUMMARY OF THE INVENTION

The present invention has been made in view of the aforementioned circumstances, and therefore, an object of the present invention is to provide a fastened structure of siding boards which is capable of easily and reliably fastening the siding boards in multistage vertically to the side of a building, irrespective of constructing a new building or reforming a used building or irrespective of the structure of building to which the siding boards are to be fastened.

Another object of the present invention is to provide a fastened structure of siding boards which is capable of preventing a load from being excessively concentrated on the joint portion of neighboring siding boards even if an expected load (surface load) is imposed on the front or rear surface of the fastened siding board attached to the side of a building, thereby preventing the fastening state of a siding board from becoming unstable even if the siding board is of large surface area.

A further object of the present invention is to provide a fastened structure of siding boards which makes it possible to easily and stably fasten a siding board to the side of a building or dismount a siding board therefrom even if the siding board is of large surface area.

With a view to realize the aforementioned objects, the present invention provides a fastened structure of siding boards for fastening the siding boards in multistage vertically to the side of a building, the fastened structure having the following characteristics.

Namely, the side of a building is provided with a number of first engaging members which are arrayed in vertical as well as horizontal directions of the side of a building at predetermined intervals, each of the first engaging members having an engaging groove and an engaging hook.

On the other hand, the siding board is provided on the rear surface thereof with a number of a second engaging members which are arrayed in vertical as well as horizontal directions of the siding board at predetermined intervals, each of the second engaging members being enabled to be inserted into the engaging groove of each of the first engaging members and provided with an engaging projection which is adapted to be engaged with said engaging hook of the first engaging member as the second engaging members are inserted into the engaging groove of the first engaging member, thereby preventing the second engaging member from being disengaged from the first engaging member.

Further, the siding boards are fastened in multistage vertically to the side of the building under a condition where the engaging projection of the second engaging member of the siding board is engaged with the engaging hook of the first engaging member fixed to the side of the building.

According to the aforementioned fastened structure, each (individual) siding board is prevented from being dismounted through an engagement between a plurality of engaging projections attached to the rear surface of the siding board and a plurality of engaging hook attached to the side of a building. This means that when a surface load is imposed on the front or rear surface of the fastened siding board, the load is borne not by the upper and lower horizontal edges of the siding board but by a large number of engaging portions dispersedly located on the rear surface of the siding board. Therefore, even if the siding board is fairly large in surface area, it is possible to ensure a stable fastened condition of the siding board, to prevent the engaged portion of the siding board from being disengaged and to prevent the siding board from being damaged. Further, since the load to be imposed on the individual engaging portion can be minimized as compared with the load to be imposed on the joint portion of siding boards according to the conventional fastening member, the tolerance or resistivity against the pulling of the fastening portion of the first engaging member to the side of a building as well as the tolerance or resistivity against the pulling of the fastening portion of the second engaging member to the rear surface of a siding board can be alleviated. Accordingly, the attachment of these engaging members to the side of a building or to the rear surface of a siding board can be facilitated, thereby making it possible to directly attach the first engaging member to even a hard side of a building such as an existing mortar-finish wall.

In a preferable embodiment of the present invention, the second engaging member is formed of an elongated member having a length which is substantially identical with the length in vertical direction of the siding board, and a plurality of the engaging projections are formed at predetermined intervals along the full length of the second engaging member. By attaching a plurality of the elongated second engaging members in rows to the rear surface of the siding board along the longitudinal direction of the siding board, the strength of the siding board can be improved, thereby enabling to ensure a stable fastened state even if the siding board is of large surface area. In this case, a plurality of the first engaging members may be attached to the side of a building and arrayed vertically at substantially the same intervals as the intervals of the engaging projections formed on the second engaging member. According to this embodiment, the engagement between the first engaging member and the second engaging member can be broken up on the occasion of dismounting the siding board from the side of a building by slightly moving upward the siding board, thereby facilitating the attachment or dismounting of the siding board at the time of reform work, etc.

In a further preferable embodiment, the first engaging member is formed of an elongated and elastic steel plate, and the engaging hooks are arrayed along a full length of the first engaging member or along the longitudinal direction of the first engaging member at substantially the same intervals as the intervals of the engaging projections formed on the second engaging member. Since the first engaging member is formed of an elongated member, the work for attaching the first engaging member to the side of a building can be accomplished with a reduced number of steps. In this case, the length of the elongated first engaging member may be substantially the same as or multiple times as long as the vertical length of the siding board to be attached thereto. In this embodiment where the first engaging member is formed of a elastic steel plate, and the engaging hooks are arrayed along a full length of the first engaging member, by pushing the siding board against the first engaging member after the positioning in merely lateral direction, the engaging projection of the second engaging member attached to the rear surface of the siding board can be forcedly introduced into the engaging groove of the first engaging member and easily brought to engage with the engaging hook, thereby reliably preventing the siding board from being disengaged. On the other hand, in the embodiment where the engaging hooks are arrayed along the longitudinal direction of the first engaging member at predetermined intervals, the engagement between the first engaging member and the second engaging member can be easily broken up by slightly moving upward the siding board.

The attachment of the second engaging member to the rear side of the siding board can be performed in any suitable manner as long as the second engaging member can be prevented from being easily disengaged therefrom. However, it has been confirmed through experiments that the employment of a driving rivet whose tip opens while being driven is most effective. Further, although there is not any particular limitation with respect to the raw material of the siding board to be fastened, the employment of a ceramic siding board is very effective as a siding board to be fastened by making use of the fastened structure according to the present invention in view of the fact that a siding board of large surface area tends to crack due to a surface load. It is preferable that four sides or at least top and bottom horizontal sides of a siding board should be respectively formed into a shiplap configuration in view of preventing rain water from penetrating through the joint portion between the neighboring siding boards fastened in this manner.

As mentioned above, the fastened structure of siding boards according to the present invention is advantageous in that it can be applied to any desired side of any desired building. In particular, when the building to be worked comprises a wooden framework of wood frame construction (two-by-four construction) or framework construction, or a steel framework, the first engaging member can be easily and reliably attached taking advantage of the studs (vertical frame) constituting these frameworks, thereby accomplishing a fastened structure of siding boards.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 illustrates in details the first engaging member to be employed in the fastened structure of the present invention, wherein

FIG. 4 illustrates in details the second engaging member to be employed in the fastened structure of the present invention, wherein

FIG. 7 illustrates an engaged state between the first engaging member and the second engaging member, wherein

DESCRIPTION OF THE PREFERRED EMBODIMENTS

Figure 1:
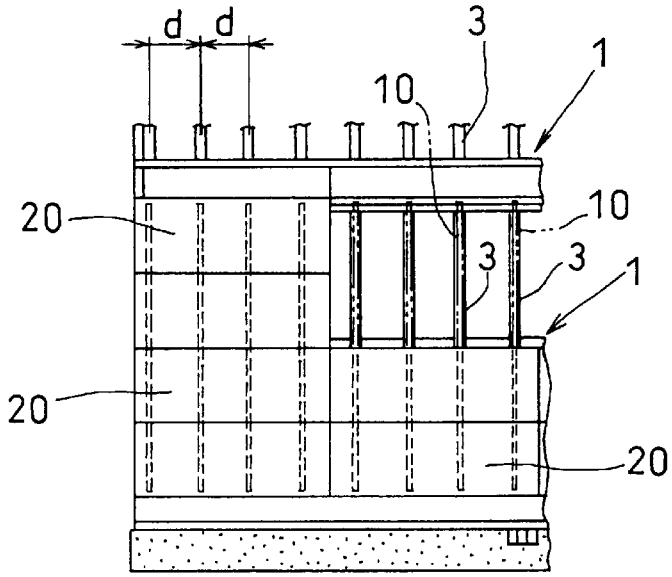
FIG. 1 is a schematic side view of a fastened structure of siding boards representing one embodiment of the present invention wherein the fastened structure is applied to a building of wood frame construction (two-by-four construction)

Preferable embodiments of the present invention will be explained in details below with reference to the drawings. FIG. 1 shows a schematic side view of a fastened structure of siding boards representing one embodiment of the present invention wherein the fastened structure is applied to a building of wood frame construction (two-by-four construction). In this embodiment, a backing or underlying material such as a plywood or moisture permeable water proof sheet (not shown) is attached to cover an assembled framework 1, and then, a first engaging member 10 indicated by an imaginary line is vertically fixed through this underlying material to the studs (vertical frame) 3 of the framework 1 by means of screws 4 (see FIG. 2*b*). Then, by taking advantage of the first engaging member 10, siding boards 20 each provided on the rear surface thereof with a second engaging member 30 are fastened horizontally and in multistage to the side of a building. The intervals between the studs 3 may be selected optionally, the intervals in this embodiment being 45.5 cm. The first engaging member 10 may be attached to all of the studs 3 or to every second studs (distance is 2*d*) or to every third studs (distance is 3*d*).

Figure 2A:
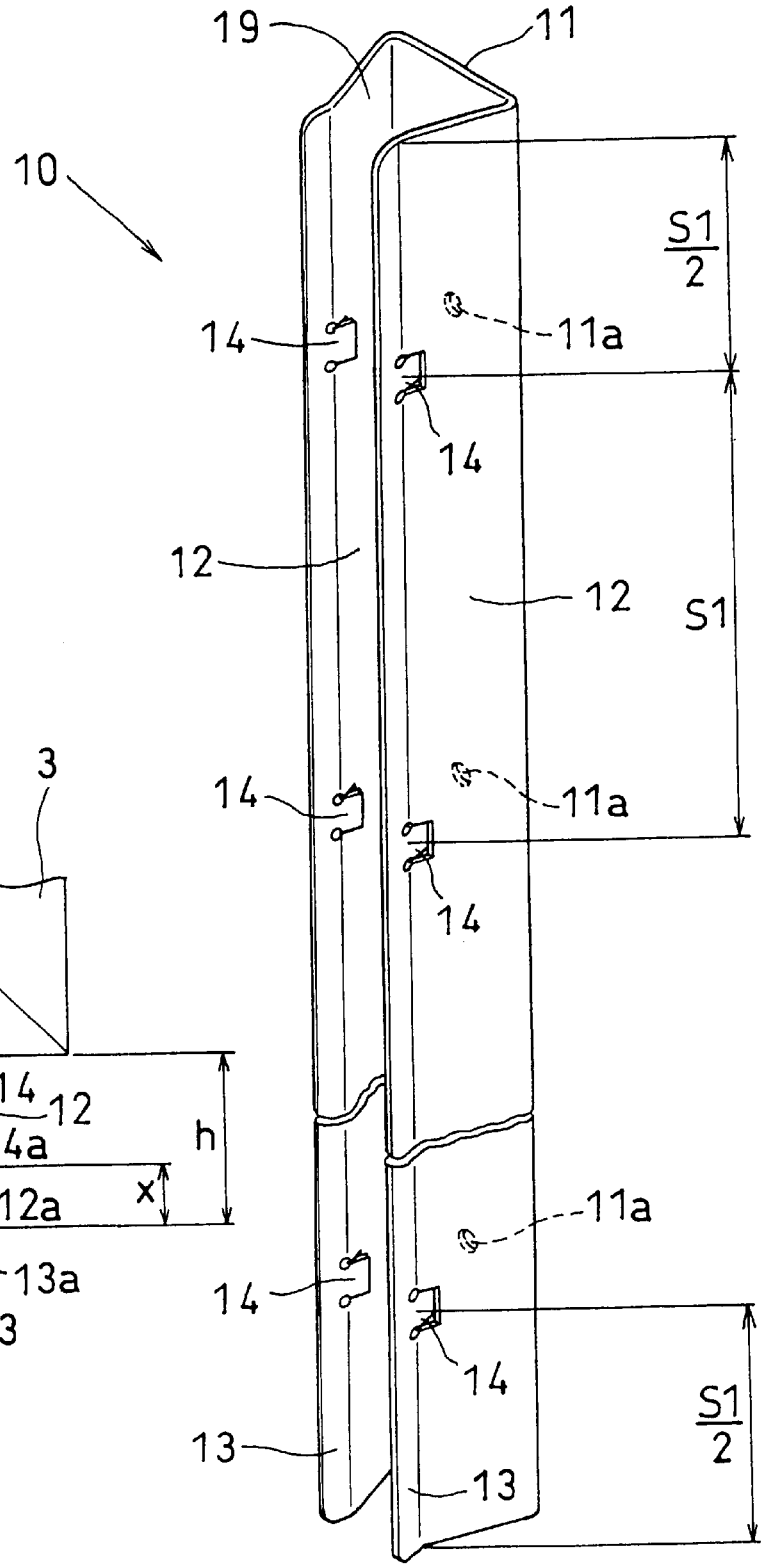
FIG. 2*a* is a perspective view illustrating the entire structure of the first engaging member.
Figure 2B:
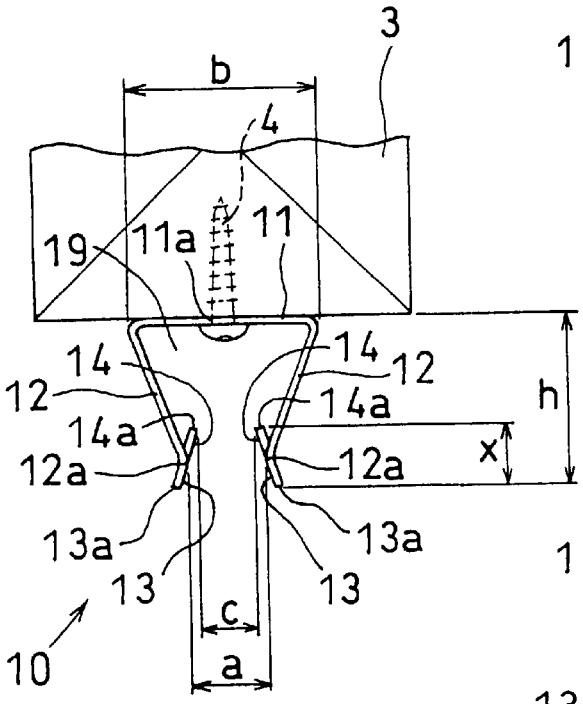
FIG. 2*b* is a top view illustrating a state wherein the first engaging member is attached to a stud.

FIG. 2 illustrates in details the first engaging member 10, wherein FIG. 2*a* is a perspective view illustrating the entire structure of the first engaging member 10; and FIG. 2*b* is a top view illustrating a state wherein the first engaging member 10 is attached to a stud 3. This first engaging member 10 is entirely formed of a spring steel, and comprises an engaging groove 19 which is defined by a flat bottom 11 and sides 12, 12 projected forward from both sides of the flat bottom 11. The fore-ends 12*a*, 12*a* of these sides 12, 12 are connected respectively with expanding surface portions 13, 13 which are expanded externally. The flat bottom 11 constitutes a mounting surface for settling the first engaging member 10 to the stud 3 and therefore, is provided with a plurality of screw holes 11*a*. The distal ends 13*a* of the expanding surface portions 13, 13 function to sustain the rear surface of the siding board 20 to be fastened. The length of the first engaging member 10 may be substantially the same as or multiple times as long as the height (in vertical direction) of the siding board 20 to be fastened. Alternatively, the length of the first engaging member 10 may be adjusted to a suitable length in the working site.

The distance "h" between the bottom 11 and these distal ends 13*a* of the expanding surface portions 13, 13 functions to secure a space between the siding board 20 being fastened and the studs 3, and hence, the distance "h" should preferably be 1 cm or so in general. Further, the distance "a" between a pair of fore-ends 12*a*, 12*a* of these sides 12, 12 is made narrower than the width "b" of the bottom 11. A plurality of cut and raised pieces 14, 14 facing each other to form a facing pair respectively are formed inside the groove 19 and contiguous to a portion of the sides 12, 12 which is located slightly closer to the bottom 11 than where the fore-ends 12*a*, 12*a* of these sides 12, 12 are located. Each facing pair of cut and raised pieces 14, 14 are spaced away from each other by a distance of "s1", and the distal ends of cut and raised pieces 14, 14 are symmetrically inclined, and hence, the distance "c" between the distal ends 14*a*, 14*a* thereof are made smaller than the distance "a" between a pair of fore-ends 12*a*, 12*a*of these sides 12, 12. Preferably, the cut and raised pieces 14, 14 should be formed contiguous with the expanding surface portions 13, 13 thereby forming a continuous inclined surface.

Further, each of the first engaging member 10 has a length which is integer multiple times as large as the distance of "s1", and a first pair of cut and raised pieces 14, 14 are located at a distance of s1/2 as measured from the lowermost (uppermost) portion of the first engaging member 10. These cut and raised pieces 14, 14 constitute in the present invention the aforementioned "engaging hooks".

Figure 3:
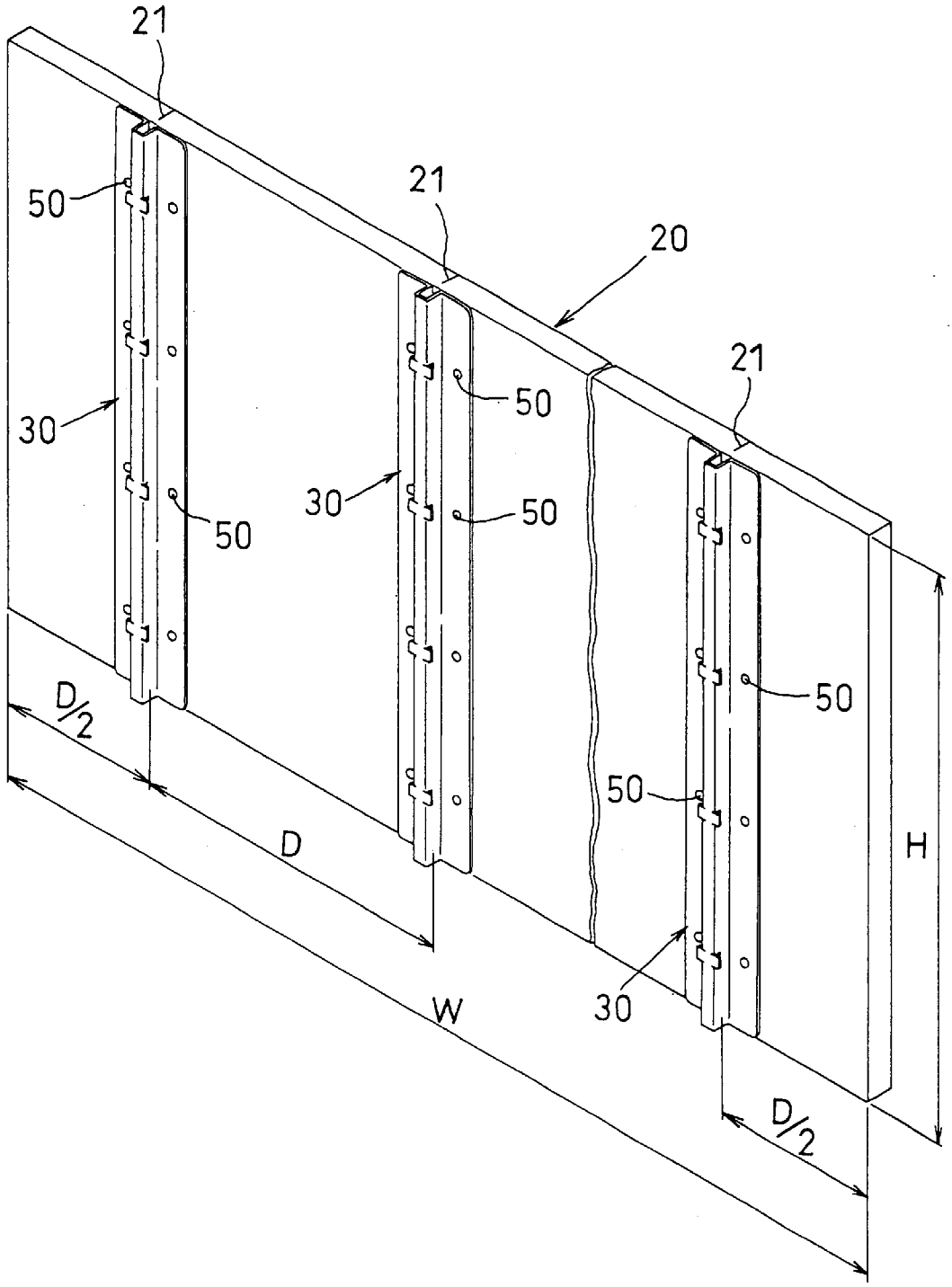
FIG. 3 is a perspective view illustrating one embodiment of a siding board to be fastened to the side of a building shown in FIG. 1.

FIG. 3 shows a perspective view illustrating one embodiment of a siding board 20 to be fastened to the side of a building shown in FIG. 1, the siding board 20 being viewed from the rear side thereof. In this embodiment, the siding board 20 is made of a ceramic siding board having a height H which is integer multiple times as large as the distance of "s1" between neighboring pair of the cut and raised pieces 14, 14 of the aforementioned first engaging member 10, and a width W which is integer multiple times as large as the distance of "d" between neighboring studs 3. As shown in FIG. 4 in detail, the siding board 20 is provided on the rear surface thereof with a plurality of elongated second engaging members 30 each having a length which is identical with the height H of the siding board 20 (for example, in the case of horizontal board siding work, the height H is 455 mm, and in the case of vertical board siding work, the height H is 3030 mm), these second engaging members 30 being vertically attached side by side at constant intervals D to the siding board 20 and along the longitudinal direction of the siding board 20. This intervals D should preferably be the same as the intervals "d" of the studs 3, but may be the intervals "2d" or "3d". The point is make the intervals D identical with the distance between the neighboring first engaging members 10 that have been attached to the studs 3 of building.

Figure 12:
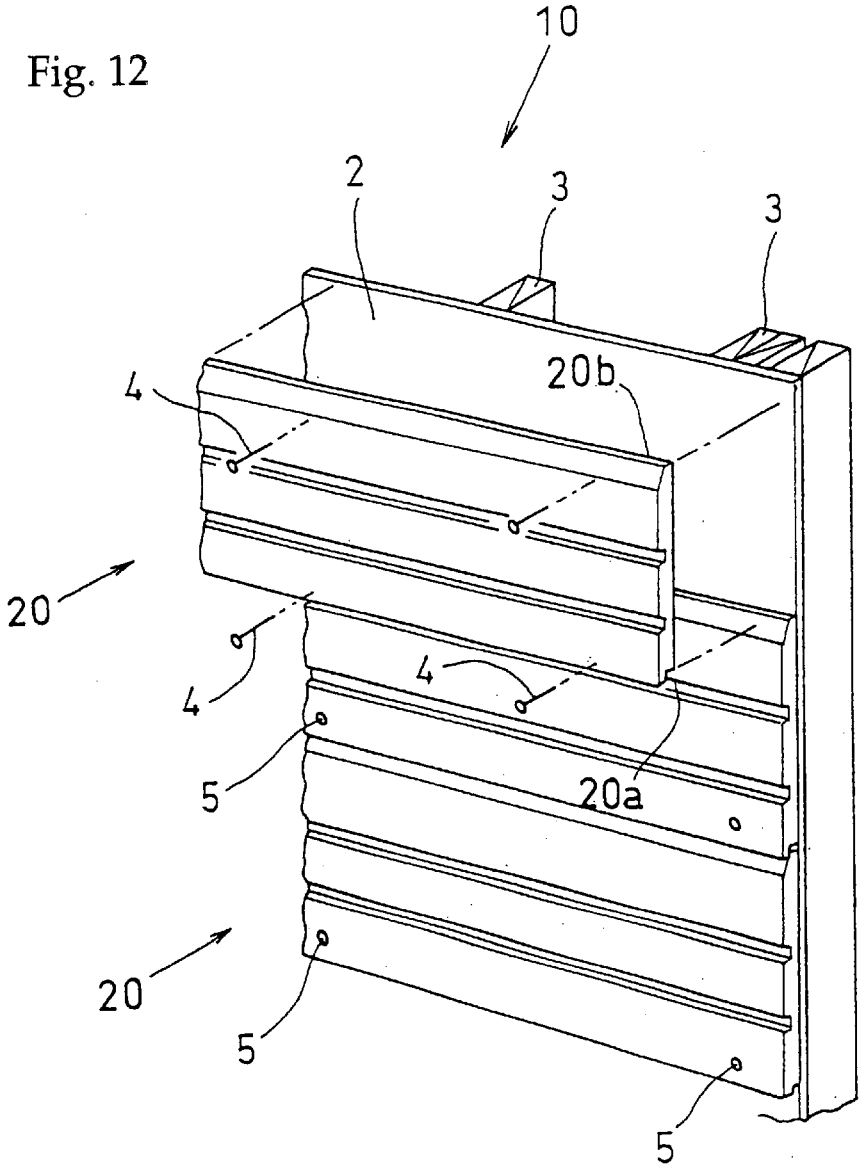
PRIOR ART Fig. 12
FIG. 12 is a perspective view illustrating a siding work of the prior art for installing one embodiment of fastening ceramic siding boards to the side of a building.
Figure 13:
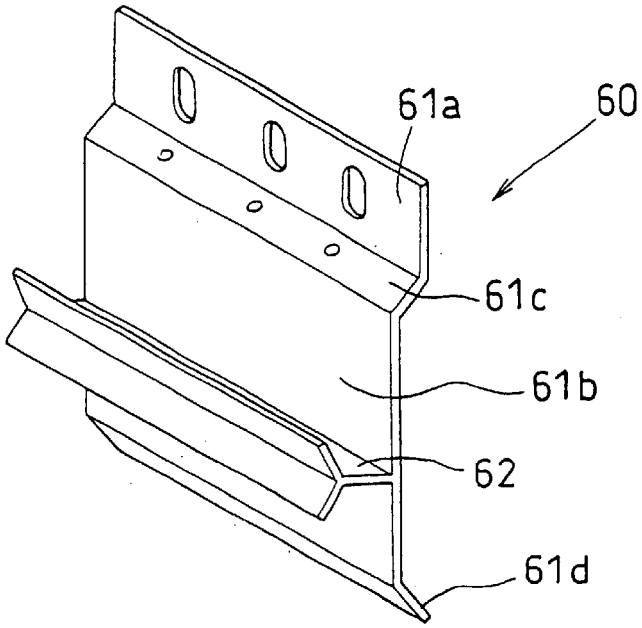
PRIOR ART Fig. 13
FIG. 13 is a perspective view illustrating one example of a fastening member of the prior art, which is employed for fastening ceramic siding boards to the side of a building in a siding work of building.
Figure 14:
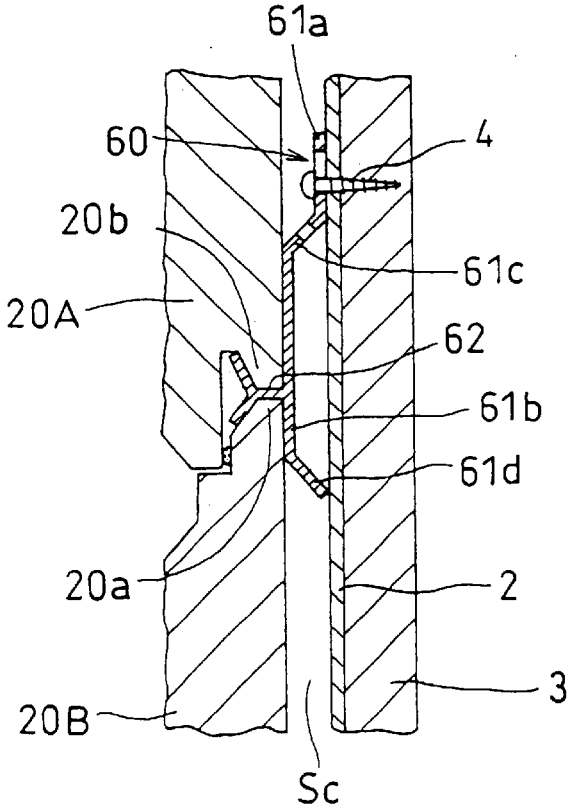
PRIOR ART Fig. 14
FIG. 14 is a cross-sectional view illustrating a state where the ceramic siding boards are fastened to the side of a building by making use of the fastening member shown in FIG. 13.

It is preferable that as shown in FIGS. 12 and 14, four sides of the siding board 20 should be respectively formed into a shiplap configuration (not shown in FIG. 3), and a mark such as a small cut-out portion 21 is formed at the upper horizontal edge and/or the lower horizontal edge for the purpose of enabling an operator to recognize the fastening position of the second engaging member 30.

Figure 4A:
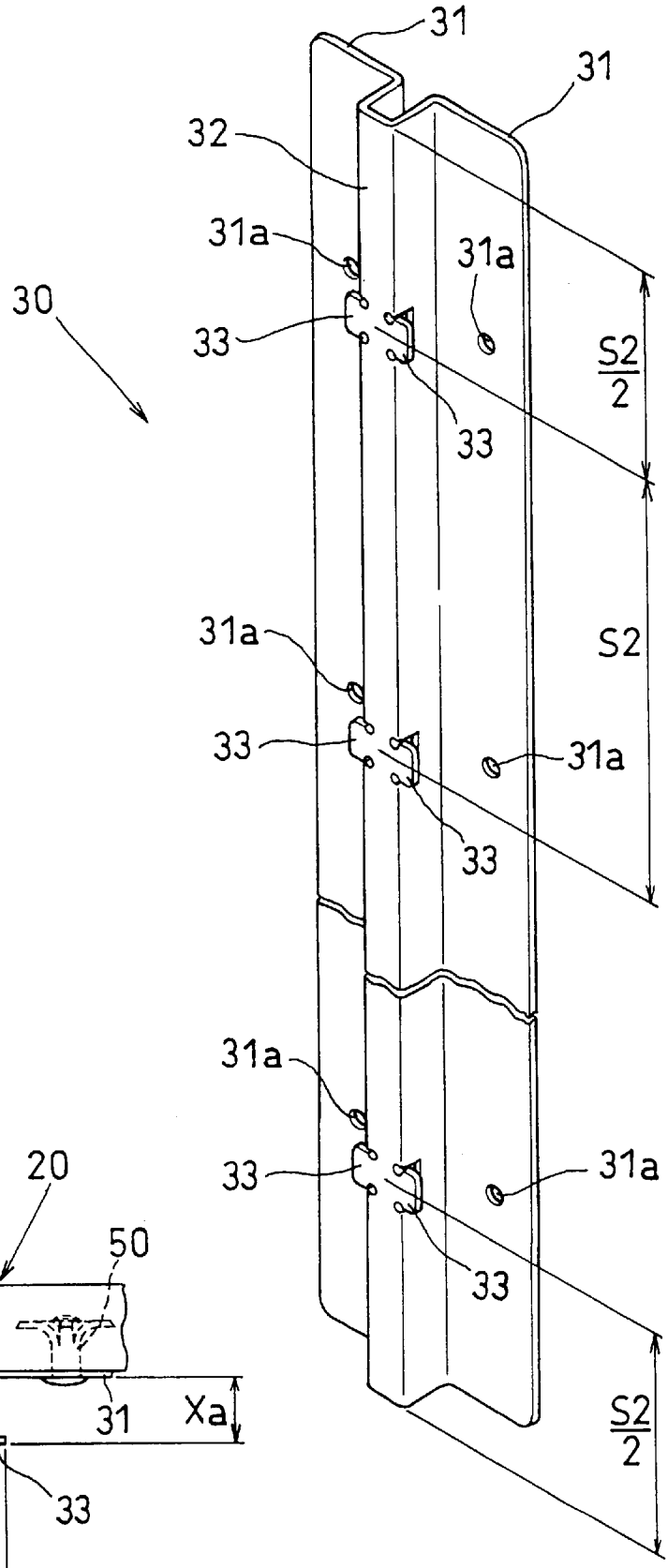
FIG. 4*a* is a perspective view illustrating the entire structure of the second engaging member.
Figure 4B:
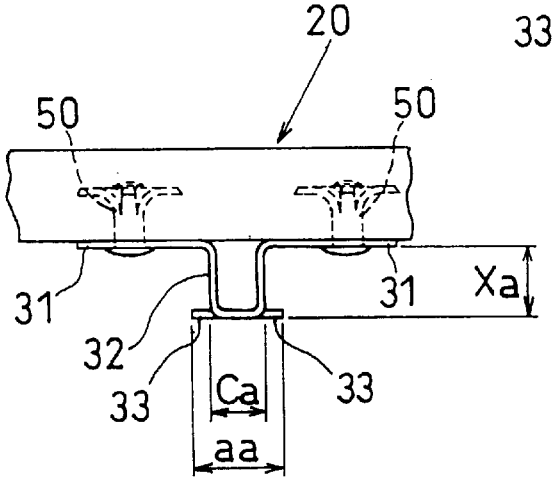
FIG. 4*b* is a top view illustrating a state wherein the second engaging member is attached to a siding board.

FIG. 4 illustrates in details the second engaging member 30, wherein FIG. 4*a* is a perspective view illustrating the entire structure of the second engaging member 30; and FIG. 4*b* is a top view illustrating a state wherein the second engaging member 30 is attached to a siding board 20. This second engaging member 30 may be entirely formed of a spring steel or an ordinary steel, and comprises a pair of flat bottom face plates 31, and a rib 32 which is located between the aforementioned pair of flat bottom face plates 31 as shown in FIG. 4. The rib 32 is provided near the top thereof with a plurality of cut and raised portions (engaging projections) 33, 33, forming several pairs of cut and raised portions 33, 33, which are spaced away from each other by a distance of "s2" along the longitudinal direction of the rib 32, each cut and raised body 33, 33 in each pair extending horizontally (parallel with the bottom face plates 31) and in the opposite direction to each other. The bottom face plates 31 constitute a mounting surface for settling the second engaging member 30 to the rear side of the siding board 20 and therefore, are provided respectively with several rivet holes 31*a* for retaining a driving rivet 50 whose tip opens. The width "ca" of the rib 32 is made slightly smaller the distance "a" between a pair of fore-ends 12*a*, 12*a* of these sides 12, 12 of the first engaging member 10. Further, the distance "aa" between the tip ends of pair of cut and raised portions 33, 33 is made slightly larger than the distance "c" between the distal ends 14*a*, 14*a* of the cut and raised pieces 14, 14.

Further, the distance of "s2" between a pair of cut and raised portions 33, 33 in the longitudinal direction of the rib 32 is made identical with the distance of "s1" between a pair of cut and raised pieces 14, 14 formed in the longitudinal direction of the first engaging member, and a first pair of cut and raised portions 33, 33 are located at a distance of s2/2 as measured from the lowermost (uppermost) portion of the second engaging member 30. These cut and raised portions 33, 33 are successively formed at intervals of "s2". The distance "xa" between the flat bottom face plates 31 and the pair of cut and raised portions 33, 33 in the second engaging member 30 is made identical with or slightly larger than the distance "x" between the distal ends 13*a* of the expanding surface portions 13, 13 and the distal ends 14*a*, 14*a* of the cut and raised pieces 14, 14. By the way, these cut and raised portions 33, 33 constitute in the present invention the aforementioned "engaging projections".

Figure 5:
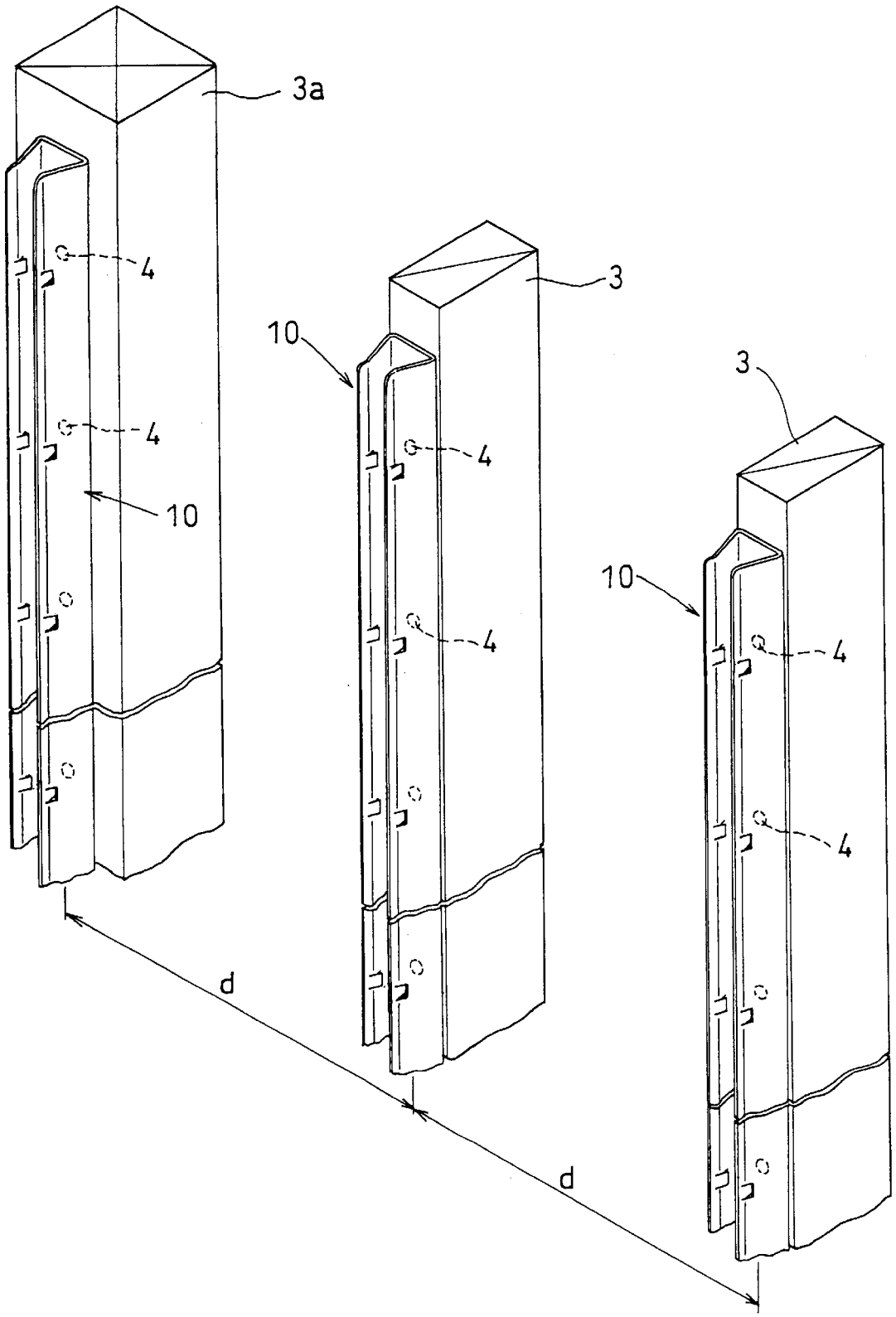
FIG. 5 is an enlarged perspective view of the first engaging member to be employed in the fastened structure according to the present invention.

The construction of the fastened structure of siding boards according to the present invention can be performed as follows. First of all, as described above and as shown in FIG. 5, by taking advantage of the studs 3 or poles 3*a* of the wooden framework 1 of wood frame construction, the first engaging members 10 are attached to the side of a building by means of screws 4 at predetermined intervals of "d" (or 2*d*, 3*d*, etc.). By the way, depending on the length of the first engaging members 10, a required number of the first engaging members 10 can be continuously attached in the vertical direction. In this case, the total number of the first engaging members 10 which is required for covering the entire side of a building can be prepared in advance, or alternatively, the first engaging members 10 may be successively added to the previously attached first engaging members 10 in conformity with the successive fastening of the siding boards 20. On the other hand, as shown in FIG. 3, the second engaging members 30 are also attached to the rear surface of the siding board 20 at predetermined intervals of "D" (or 2D, 3D, etc.) (in this case however, d=D).

Figure 6A:
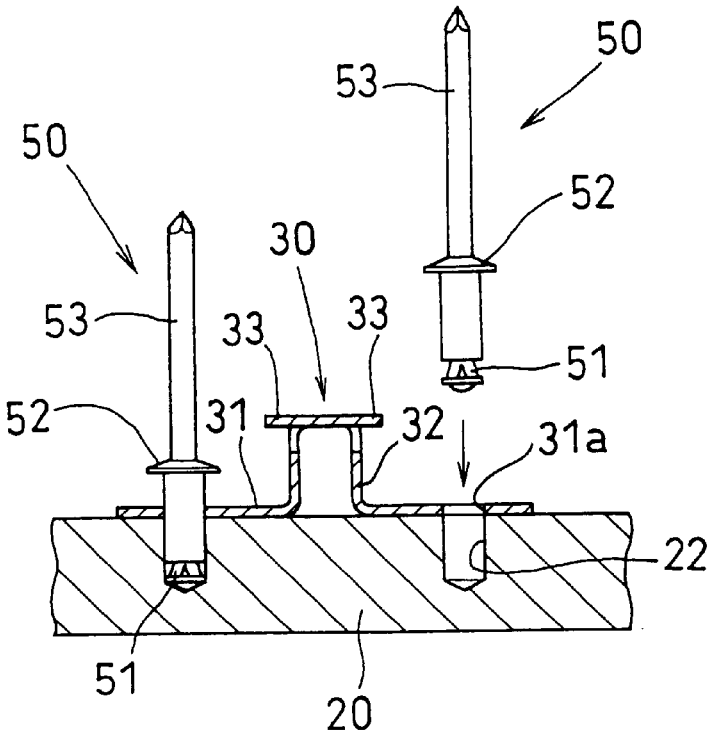
FIG. 6 is a partial sectional view illustrating a method of attaching the second engaging member to the rear surface of a siding board by making use of a driving rivet whose tip opens while being driven.
Figure 6B:
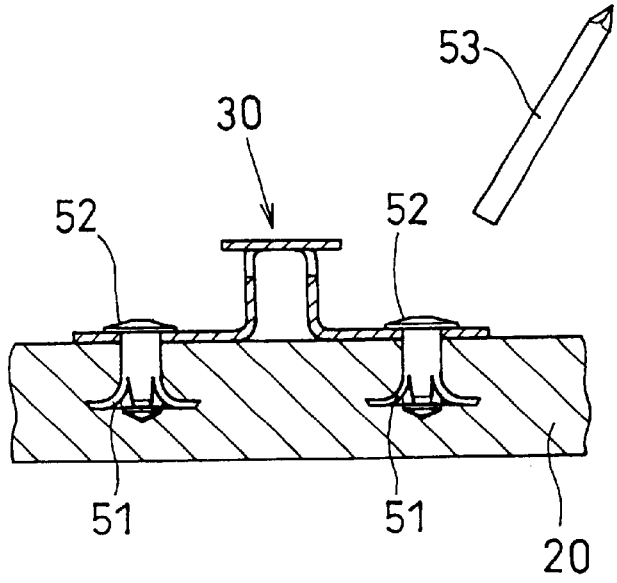

FIGS. 6*a* and 6*b* show respectively a partial sectional view illustrating a method of attaching the second engaging member 30 to the rear surface of a siding board. As shown in FIG. 6*a*, a bottomed hole 22 is formed at a predetermined portion of the rear surface of the siding board 20 where the rivet holes 31*a* of the second engaging member 30 is to be positioned in the attachment of the second engaging member 30. Then, a driving rivet 50 whose tip opens is introduced via the rivet holes 31*a* into the bottomed hole 22, thereby setting the driving rivet 50 in place. This settled driving rivet 50 is then driven further into the bottomed hole 22 by means of a driving machine (not shown), thereby allowing the distal end 51 of driving rivet 50 to open and intrude into the siding board 20 as shown in FIG. 6*b*. As a result, the flat bottom face plates 31 of the second engaging member 30 are clamped in an immobilized manner between the rivet head 52 and the rear surface of the siding board 20, thereby fixing the second engaging member 30 to the rear surface of the siding board 20. By the way, after the fixing of the second engaging member 30, the supporting shaft 53 of the rivet 50 is removed by any suitable means.

In this manner, the siding board 20 provided on the rear surface thereof with a required number of second engaging members 30 is manufactured (see FIG. 3).

Figure 7A:
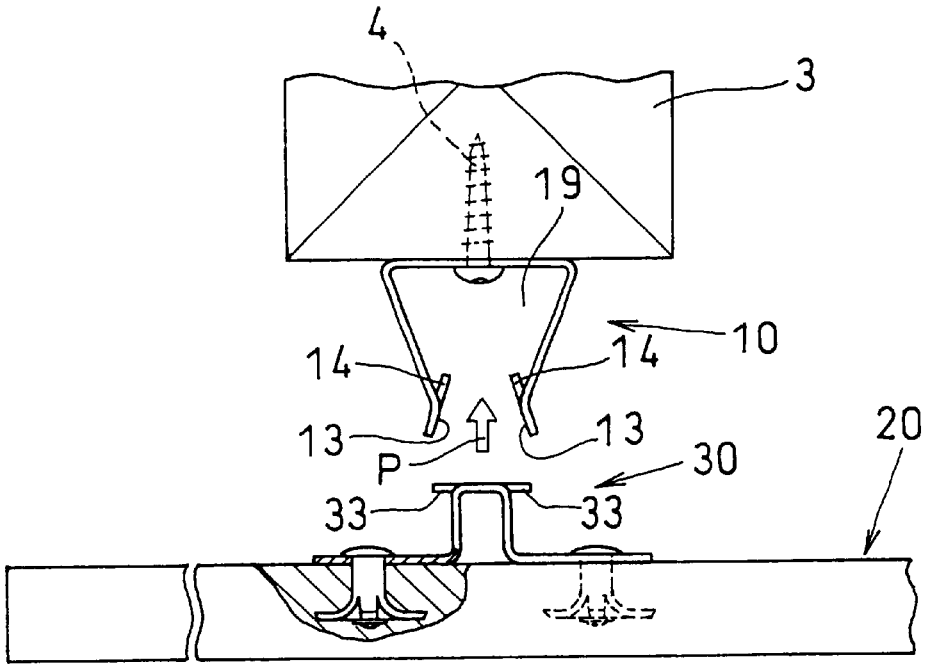
FIG. 7*a* shows a state before the engagement.

In the fastening work of siding boards, the positioning in lateral direction of a first siding board 20 is performed in such a manner that the second engaging members 30 attached to the rear surface of the siding board 20 are correctly positioned to face the first engaging members 10 attached to the side of a building. In this case, by making use of the mark 21 formed on the horizontal edge of the siding board 20, this positioning work can be facilitated. The positioning in the vertical direction may not be so stringent. FIG. 7*a* shows a partial sectional view illustrating a state in which the second engaging members 30 is positioned in this manner.

Under this condition, the siding board 20 is pushed toward the side of a building. As a result, both distal end portions of a plural number of the cut and raised portions 33, 33 formed on the second engaging member 30 are impinged against the expanding surface portions 13, 13 of the first engaging member 10, thereby enabling the distal end portions of the cut and raised portions 33, 33 to gradually advance while pushingly expanding the opening formed between the expanding surface portions 13, 13. Finally, the distal end portions of the cut and raised portions 33, 33 are moved further beyond the fore-ends 12*a*, 12*a* of these sides 12, 12 to enter into the engaging groove 19 defined by the bottom 11 and both sides 12, 12. When the vertical position of the siding board 20 being thrust is such that the position of the cut and raised portions 33, 33 is brought to align with the position of the cut and raised pieces 14, 14 of the first engaging member 10, the distal end portions of the cut and raised portions 33, 33 are also impinged against the cut and raised pieces 14, 14 to pushingly expanding the engaging groove 19 so as to allow the distal end portions of the cut and raised portions 33, 33 move beyond the distal ends 14*a*, 14*a* of the cut and raised pieces 14, 14, thus ultimately enabling it to enter into the engaging groove 19.

Figure 7B:
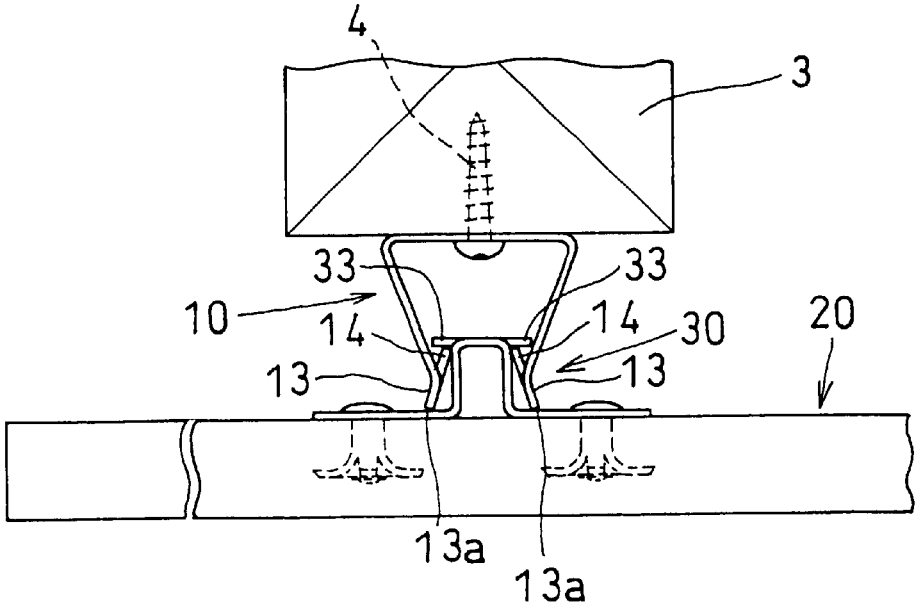
FIG. 7*b* shows a state after the engagement.

As shown in FIG. 7*b*, under this condition, the cut and raised portions 33, 33 formed on the second engaging member 30 are placed inner than the distal ends of the cut and raised pieces 14, 14 of the first engaging member 10, so that the siding board 20 is enabled, while being guided by the first engaging member 10, to move up and down in a state wherein the rear surface of the siding board 20 is received by the distal ends 13*a* of the expanding surface portions 13, 13 of the first engaging member 10. When the siding board 20 fastened in this manner is then allowed to fall down to the lowermost position of the side of a building, the cut and raised portions 33, 33 formed on the second engaging member 30 are enabled to be automatically engaged with the cut and raised pieces 14, 14 of the first engaging member 10 as these cut and raised portions 33, 33 and cut and raised pieces 14, 14 are positioned in the aforementioned positional relationship, thereby making it possible to fasten the siding board 20 to the side of a building while preventing the siding board 20 from being disengaged from the first engaging member 10. The aforementioned procedures are repeated to successively fasten siding boards in the lateral direction as well as in the vertical direction, thereby accomplishing a decorative side of a building which is constituted by the fastened structure of siding boards according to the present invention.

According to the aforementioned fastened structure, the siding board 20 is fastened without fail through an engagement between a plurality of cut and raised portions (engaging projections) 33, 33 of the second engaging member 30 attached to the rear surface of the siding board 20 and a plurality of cut and raised pieces (engaging hooks) 14 of the first engaging member 10 attached to the side of a building. Accordingly, even if a surface load by the blowing of wind is imposed onto the rear surface of the siding board 20 being fastened to the side of a building, the load can be dispersedly shared by a plurality of engaging portions, thereby ensuring a stable fastening state of the siding board even if the siding board is of large surface area. Further, since the load to be imposed onto each engaging portion can be minimized due to the dispersion thereof as mentioned above, the manner of fastening the first engaging member 10 to the side of a building as well as the manner of fastening the second engaging member 30 to the rear surface of the siding board 20 can be simplified.

Additionally, since the second engaging member 30 is formed of an elongated member having the same length as the vertical length of the siding board 20, and furthermore, since this elongated member is attached plurally to the siding board at predetermined intervals and along the longitudinal direction of the siding board, the strength of the flat siding board 20 can be greatly improved, thus generating an additional effect. Moreover, since the cut and raised pieces 14, 14 formed on the first engaging member 10 are provided at the same intervals as the intervals of the cut and raised portions 33, 33 formed on the second engaging member 30, the reliability of fastening state can be ensured. When siding boards are desired to be dismounted from the side of a building on the occasion of reforming a building for instance, it can be performed by the following process. Namely, one upper siding board is removed by cracking it and then, the first engaging members behind this siding board are detached from the side of a building. Thereafter, the siding boards installed below this upper siding board are successively lifted up and then, pulled out, thus easily remove them from the side of a building. Alternatively, these siding boards can be removed by pulling them out under the condition where the cut and raised pieces 14, 14 are caused to disengage from the cut and raised portions 33, 33.

Figure 8:
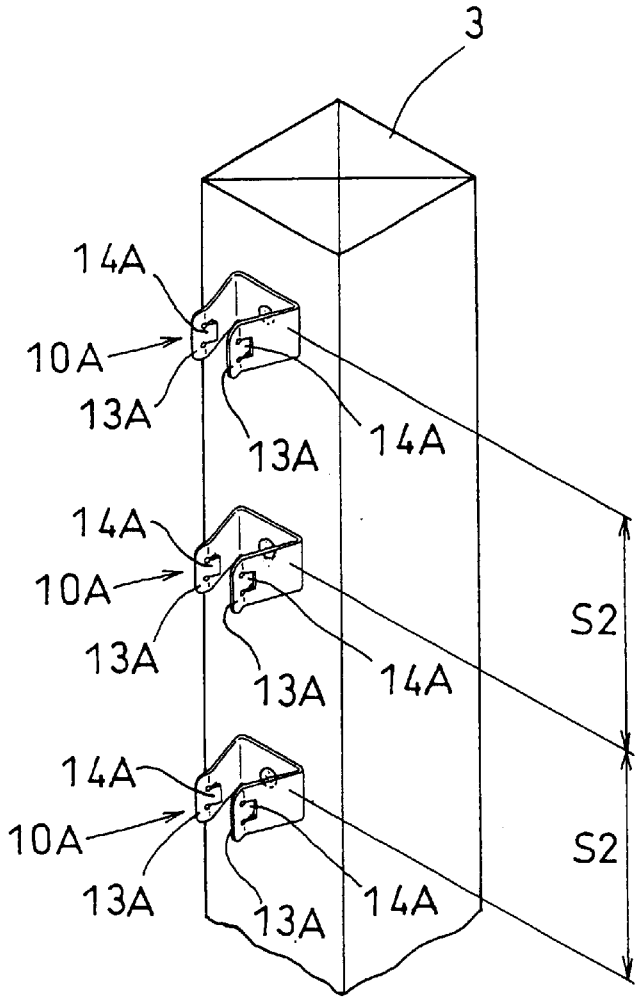
FIG. 8 is a perspective view illustrating another embodiment of the first engaging member to be employed in the fastened structure according to the present invention.

FIG. 8 shows another embodiment of the first engaging member to be employed in the fastened structure according to the present invention. This first engaging member 10A is not such an elongated member as that shown in FIG. 2 where a plurality of engaging hooks (cut and raised pieces 14, 14) are attached to each first engaging member, but a short member where only one engaging hook 14A is attached to each first engaging member. The cross-sectional configuration of this first engaging member 10A is the same as that shown in FIG. 2. Namely, this first engaging member 10A is constructed and employed in the same manner as illustrated in FIGS. 1 to 7 except that a required number of the first engaging members 10A are attached to the side of a building (or more preferably, the stud 3) in multistage at the same intervals as the intervals "s2" between a pair of cut and raised portions 33, 33 formed on the aforementioned second engaging member 30.

The employment of the first engaging member 10A according to this embodiment is advantageous in that the manufacture thereof can be simplified and that the installation of the siding board 20 can be performed more simply as follows. Namely, the positioning in lateral direction of the siding board 20 provided on the rear surface thereof with the second engaging members 30 is performed at first to obtain a state shown in FIG. 7*a*, after which the siding board 20 is slightly lifted upward and then pushed toward the studs 3 to obtain a positional relationship between the first engaging member 10 and the second engaging member 30 as shown in FIG. 7*b*, the siding board 20 being subsequently allowed to fall downward to obtain a predetermined engaged state between the cut and raised pieces 14, 14 and the cut and raised portions 33, 33. In this case, since the interval between the expanded surfaces 13A of the first engaging member 10A is no more required to be further expanded as the first engaging member 10A is brought to engage with the second engaging member 30 as shown in FIG. 7*b*, the fastening work of siding boards can be simplified. It is of course possible to obtain a predetermined engaged state between the cut and raised pieces 14, 14 and the cut and raised portions 33, 33 by a procedure wherein the positioning in lateral direction of the siding board 20 is performed at first, and then, the siding board 20 is set so as to allow the cut and raised pieces 14, 14 to face the cut and raised portions 33, 33, after which the cut and raised portions 33, 33 is thrust forward to expand the interval between the expanded surfaces 13A of the first engaging member 10A, thereby obtaining a predetermined engaged state between the cut and raised pieces 14, 14 and the cut and raised portions 33, 33.

Figure 9:
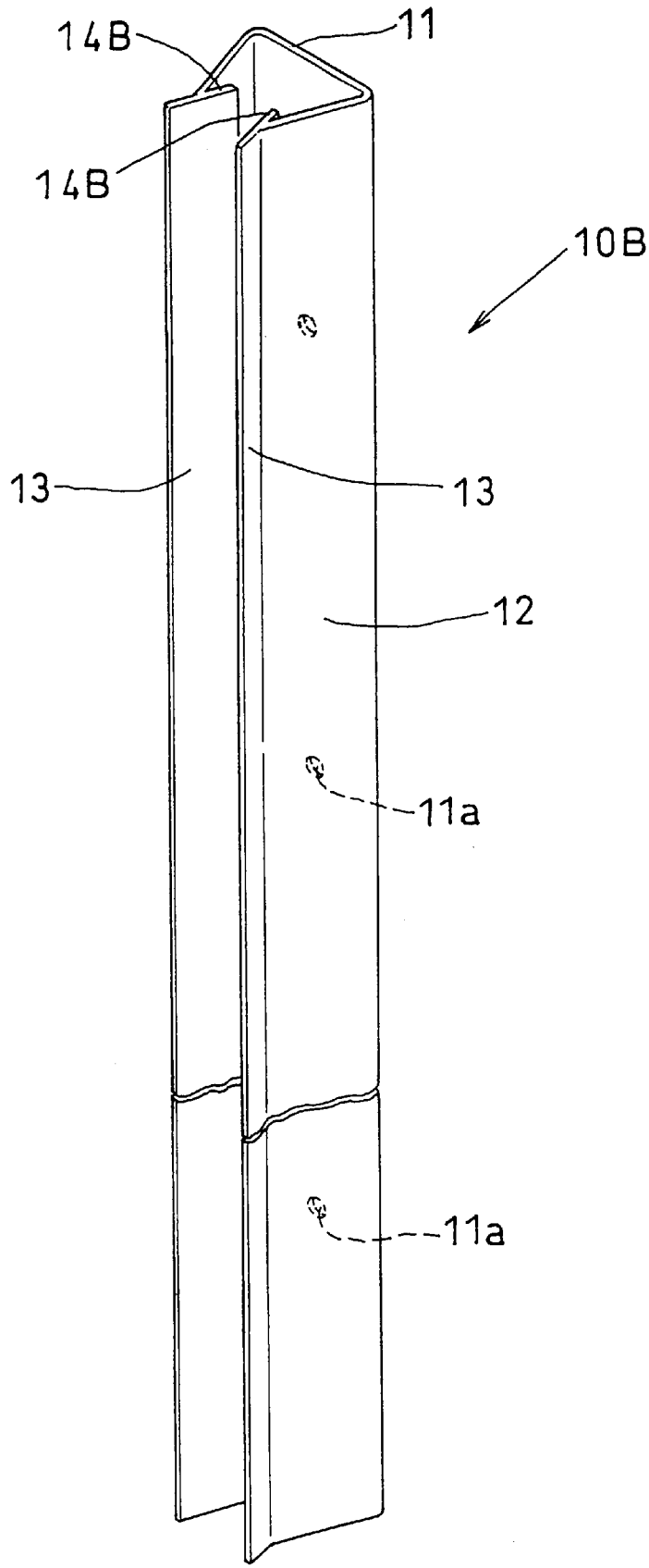
FIG. 9 is a perspective view illustrating a further embodiment of the first engaging member to be employed in the fastened structure according to the present invention.

FIG. 9 shows a further embodiment of the first engaging member to be employed in the fastened structure according to the present invention. This first engaging member 10B is no more provided with a plurality of engaging hooks (cut and raised pieces 14, 14) as in the case of the first engaging member 10 shown in FIG. 2, but only a single elongated engaging strip 14B is formed along the entire length of the first engaging member 10B. Other structural components are the same as those of the first engaging member 10. By the way, in the embodiment shown in FIG. 9, although the elongated engaging strip 14B is formed integral with the expanded surfaces 13, a separate elongated engaging strip may be attached to the first engaging member 10B by means of welding for instance.

The employment of this first engaging member 10B is advantageous in that since a plurality of engaging projections (cut and raised portions 33, 33) can be brought to engage with this elongated first engaging member 10B at any optional position, the vertical positioning of the second engaging member 30 relative to this first engaging member 10B can be facilitated.

Figure 10:
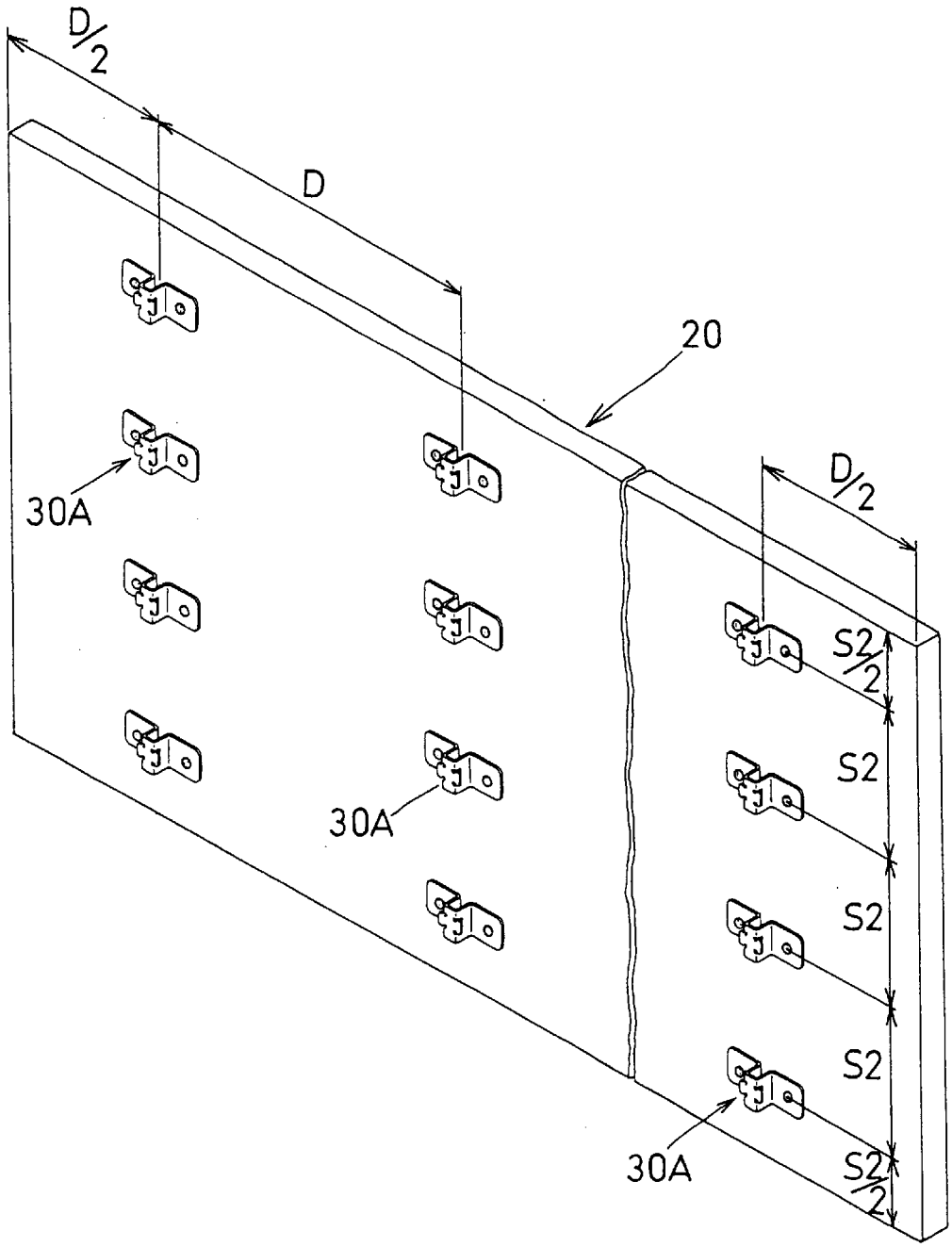
FIG. 10 is a perspective view illustrating a state wherein the second engaging members according to another embodiment and to be employed in the fastened structure of the present invention are attached to the rear surface of a siding board.
Figure 11:
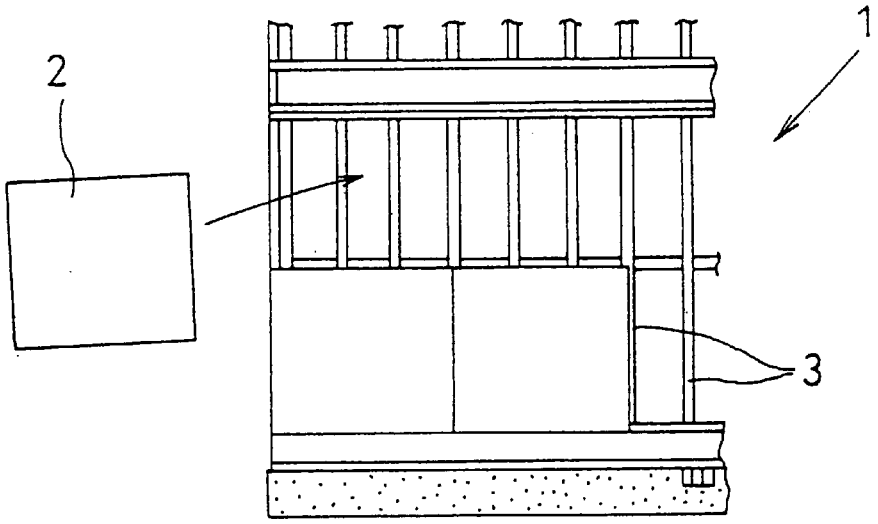
Fig. 11 PRIOR ART
FIG. 11 is a side view illustrating the wood frame construction (two-by-four construction)

FIG. 10 shows a state wherein the second engaging members according to another embodiment are attached to the rear surface of a siding board 20. This second engaging member 30A is not such an elongated member as that shown in FIGS. 3 and 4 where a plurality of engaging projections (cut and raised portions 33, 33) are attached to each second engaging member, but a short member provided with only one engaging piece 33*a*, 33*a*. The cross-sectional configuration of this second engaging member 30A is the same as that shown in FIGS. 3 and 4. As shown in FIG. 10, a plurality of second engaging members 30A are attached to the siding board 20 in multistage and at the same intervals as the intervals "s2" between a pair of cut and raised portions 33, 33 formed on the aforementioned second engaging member 30. The configuration of the first engaging member, i.e. the counter member, may be of any type as explained above.

This fastened structure using the siding board 20 provided with this second engaging members 30A is advantageous in that the weight of the siding board to be fastened can be reduced though the aforementioned additional effect of reinforcing the siding board 20 cannot be expected in this embodiment. This second engaging members 30A is also advantageous on the occasion of dismounting siding boards in the respect that when it is used in combination with the first engaging member 10A shown in FIG. 8, the engagement between the first engaging member 10A and the second engaging member 30A can be easily broken up by slightly lifting the siding board upward.

By the way, the intervals S1 of the engaging hooks (cut and raised pieces 14, 14) of the first engaging member and the intervals S2 of the engaging projections (cut and raised portions 33, 33) of the second engaging member can be optionally modified as far as the vertical position of the engaging hooks of the first engaging member is set to coincide with the vertical position of the engaging projections of the second engaging member on the occasion of fastening the siding board. Therefore, although it may be certainly preferable to set these intervals to the same distances (S1 or S2) as shown in the aforementioned figures, it should be understood that these same intervals are not essential.

According to the fastened structure of siding boards of the present invention, it is possible to easily and reliably fasten the siding boards in multistage vertically to the side of a building, irrespective of constructing a new building or reforming a used building or irrespective of the structure of building to which the siding boards are to be fastened. Furthermore, it is also possible to prevent a load from being excessively concentrated on the joint portion of neighboring siding boards even if an expected load (surface load) is imposed on the front or rear surface of the fastened siding board attached to the side of a building, thereby preventing the fastening state of siding boards from becoming unstable even if the siding board is of large surface area.

According to a preferable embodiment of the present invention, since the fastening members are enabled to function as a reinforcing material for the siding boards, a further stabilized fastened structure of siding boards can be realized.

What is claimed is:

1. A fastened structure of siding boards wherein siding boards are fastened in multistage vertically to columns and studs constituting a side of a building, said fastened structure of a siding board being characterized in that;

said columns and studs are provided with a number of first engaging members which are arrayed in vertical as well as horizontal directions of said side of a building at predetermined intervals, each of said first engaging members having an engaging groove and an engaging hook;

said siding board is provided on the rear surface thereof with a number of second engaging members which are arrayed in vertical as well as horizontal directions of said siding board at the intervals same as the said predetermined intervals, each of said second engaging members being enabled to be inserted into said engaging groove of each of said first engaging members and provided with an engaging projection which is adapted to be engaged with said engaging hook of said first engaging member as said second engaging members are inserted into said engaging groove of said first engaging member, thereby preventing said second engaging member from being disengaged from said first engaging member; and said siding boards are fastened in multistage vertically to the side of said building under a condition where said engaging projection of said second engaging member of a siding board is engaged with said engaging hook of said first engaging member fixed to the side of said building, wherein said siding board is a ceramic siding board.

2. The fastened structure of siding boards according to claim 1, wherein said second engaging member is attached to the rear surface of said siding board by means of a driving rivet whose tip opens while being driven.

3. The fastened structure of siding boards according to claim 1, wherein at least upper and lower horizontal edge portions of said siding board is made into a rabbet joint structure.

4. The fastened structure of siding boards according to claim 1, wherein said building comprises a wooden framework of wood frame construction (two-by-four construction) or framework construction, or a steel framework, and said first engaging member is attached to vertical frame constituting these frameworks.

5. A fastened structure of siding boards wherein siding boards are fastened in multistage vertically to columns and studs constituting a side of a building, said fastened structure of a siding board being characterized in that;

said columns and studs are provided with a number of first engaging members which are arrayed in vertical as well as horizontal directions of said side of a building at predetermined intervals, each of said first engaging members having an engaging groove and an engaging hook;

said siding board is provided on the rear surface thereof with a number of second engaging members which are arrayed in vertical as well as horizontal directions of said siding board at the intervals same as the said predetermined intervals, each of said second engaging members being enabled to be inserted into said engaging groove of each of said first engaging members and provided with an engaging projection which is adapted to be engaged with said engaging hook of said first engaging member as said second engaging members are inserted into said engaging groove of said first engaging member, thereby preventing said second engaging member from being disengaged from said first engaging member; and said siding boards are fastened in multistage vertically to the side of said building under a condition where said engaging projection of said second engaging member of a siding board is engaged with said engaging hook of said first engaging member fixed to the side of said building, wherein said second engaging member is formed of an elongated member having a length which is substantially identical with the length in vertical direction of said siding board, and a plurality of said engaging projections are formed at predetermined intervals along the full length of said second engaging member.

6. The fastened structure of siding boards according to claim 5, wherein a plurality of said first engaging members are attached to said side of a building and arrayed vertically at substantially the same intervals as said intervals of said engaging projections formed on said second engaging member.

7. The fastened structure of siding boards according to claim 5, wherein said first engaging member is formed of an elongated and elastic steel plate, and said engaging hooks are arrayed along a full length of said first engaging member.

8. The fastened structure of siding boards according to claim 5, wherein said first engaging member is formed of an elongated and elastic steel plate, and said engaging hooks are arrayed along the longitudinal direction of said first engaging member at substantially the same intervals as said intervals of said engaging projections formed on said second engaging member.

9. The fastened structure of siding boards according to claims 8, wherein said engaging projection of said second fastening member is designed to be inserted into and taken out of said engaging groove of said first engaging member through a portion of said first engaging member where said engaging hook is not existed.

10. The fastened structure of siding boards according to claim 8, wherein said engaging hook is formed of a cut and raised piece that has been cut out of said first engaging member.

11. The fastened structure of siding boards according to claim 10, wherein said engaging projection of said second fastening member is designed to be inserted into and taken out of said engaging groove of said first engaging member through a portion of said first engaging member where said engaging hook is not existed.

* * * * *